US011190891B2

(12) United States Patent
Kim et al.

(10) Patent No.: US 11,190,891 B2
(45) Date of Patent: Nov. 30, 2021

(54) METHOD FOR DETERMINING WHETHER ERROR HAS OCCURRED IN MICROPHONE ON BASIS OF MAGNITUDE OF AUDIO SIGNAL ACQUIRED THROUGH MICROPHONE, AND ELECTRONIC DEVICE THEREOF

(71) Applicant: Samsung Electronics Co., Ltd., Suwon-si (KR)

(72) Inventors: Yang-Su Kim, Suwon-si (KR); Youngsoo Park, Suwon-si (KR); Keun Won Jang, Suwon-si (KR); Beak-Kwon Son, Yongin-si (KR); Nam-Woog Lee, Suwon-si (KR); Sunghwan Ko, Suwon-si (KR); Gangyoul Kim, Seongnam-si (KR); Seung-Nam Kim, Suwon-si (KR); Jong-Hwan Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/652,549

(22) PCT Filed: Sep. 21, 2018

(86) PCT No.: PCT/KR2018/011200
§ 371 (c)(1),
(2) Date: Mar. 31, 2020

(87) PCT Pub. No.: WO2019/078501
PCT Pub. Date: Apr. 25, 2019

(65) Prior Publication Data

US 2020/0245086 A1 Jul. 30, 2020

(30) Foreign Application Priority Data

Oct. 17, 2017 (KR) ..... 10-2017-0134887

(51) Int. Cl.
*H04R 29/00* (2006.01)
*H04R 3/02* (2006.01)

(52) U.S. Cl.
CPC ..... *H04R 29/004* (2013.01); *H04R 3/02* (2013.01)

(58) Field of Classification Search
CPC .... H04R 29/00; H04R 29/004; H04R 29/005; H04R 29/006; H04R 3/00; H04R 3/005; H04R 3/02; H04R 3/10
(Continued)

(56) References Cited

U.S. PATENT DOCUMENTS 8,379,876 B2 * 2/2013 Zhang ..... H04R 29/005 381/92
9,635,481 B2 * 4/2017 Matsumoto ..... H04R 29/004
(Continued)

FOREIGN PATENT DOCUMENTS

JP 2016-032260 3/2016
JP 2016-116001 6/2016
(Continued)

OTHER PUBLICATIONS

International Search Report for PCT/KR2018/011200 dated Jan. 10, 2019, 4 pages.
(Continued)

*Primary Examiner* — Xu Mei
(74) *Attorney, Agent, or Firm* — Nixon & Vanderhye, P.C.

(57) ABSTRACT

Various embodiments of the present disclosure relate to an apparatus and a method for detecting an error of an audio component in an electronic device. The electronic device includes: at least one sound output device; at least one microphone; and a processor, and the processor is configured to identify a deviation related to a loudness of an audio
(Continued)

signal acquired through the at least one microphone, and to determine whether an error related to the at least one microphone occurs, based at least on the deviation. Other embodiments are possible.

16 Claims, 10 Drawing Sheets

(58) Field of Classification Search
USPC ..... 381/58, 83, 93, 91, 92, 122
See application file for complete search history.

(56) References Cited

U.S. PATENT DOCUMENTS

| | | | | |
|---|---|---|---|---|
| 9,781,533 | B2 * | 10/2017 | Lehnert | H04S 7/301 |
| 10,405,115 | B1 * | 9/2019 | Landron | H04R 29/005 |
| 2003/0139204 | A1 | 7/2003 | Lim | |
| 2012/0045068 | A1 * | 2/2012 | Kim | H04R 29/005 381/58 |
| 2015/0304786 | A1 * | 10/2015 | Partio | H04R 29/004 381/58 |
| 2016/0037277 | A1 | 2/2016 | Matsumoto et al. | |
| 2019/0297440 | A1 * | 9/2019 | Barwicz | H04R 29/004 |

FOREIGN PATENT DOCUMENTS

| | | |
|---|---|---|
| KR | 2000-0065961 | 11/2000 |
| KR | 2003-0033724 | 5/2003 |
| KR | 10-2010-0095927 | 9/2010 |
| KR | 10-2010-0112847 | 10/2010 |
| KR | 10-1700424 | 2/2017 |

OTHER PUBLICATIONS

Written Opinion of the ISA for PCT/KR2018/011200 dated Jan. 10, 2019, 5 pages.
Notice of Preliminary Rejection dated Jun. 30, 2021 in counterpart Korean Patent Application No. KR10-2017-0134887 and English-language translation.
Notice of Patent Grant dated Sep. 6, 2021 in counterpart Korean Application No. KR10-2017-0134887 and English-language translation.

* cited by examiner

FIG.9A 912 FIG.9B 914

METHOD FOR DETERMINING WHETHER ERROR HAS OCCURRED IN MICROPHONE ON BASIS OF MAGNITUDE OF AUDIO SIGNAL ACQUIRED THROUGH MICROPHONE, AND ELECTRONIC DEVICE THEREOF

This application is the U.S. national phase of International Application No. PCT/KR2018/011200 filed Sep. 21, 2018 which designated the U.S. and claims priority to KR Patent Application No. 10-2017-0134887 filed Oct. 17, 2017, the entire contents of each of which are hereby incorporated by reference.

TECHNICAL FIELD

Various embodiments of the present disclosure relate to an apparatus and a method for detecting an error of an audio component in an electronic device.

BACKGROUND ART

An electronic device may include at least one audio component for providing various functions related to audio. For example, the audio component may include at least one of a speaker, a microphone, a codec, or an amplifier. For example, when the electronic device provides a voice communication function, the electronic device may collect a voice signal to be transmitted to the other electronic device via a microphone, and may output a voice signal received from the other electronic device through a speaker. For example, when the electronic device is making a video, the electronic device may collect an ambient audio signal through the microphone. For example, when the electronic device replays a multimedia content, the electronic device may output an audio signal related to the multimedia content through the speaker.

An electronic device may detect whether an error occurs in respective modules processing an audio signal, through a digital input/output dump in each module. For example, the electronic device may determine whether an error occurs in an audio component through a pulse code modulation (PCM) data dump at a front/rear end of a module for processing a voice signal.

When the electronic device uses the digital input/output dump, data for determining whether an error occurs in the audio component may be required. For example, in the case of a European voluntary service (EVS) call, data of a predetermined capacity (for example, about 11 Mbyte) may be required to determine whether an error occurs in the audio component. Accordingly, the electronic device has a problem that efficiency of data for determining the occurrence of an error in the audio component deteriorates.

SUMMARY

Various embodiments of the present disclosure provide an apparatus and a method for detecting an error of an audio component in an electronic device.

According to various embodiments of the present disclosure, an electronic device includes: at least one sound output device; at least one microphone; and a processor, and the processor may be configured to: identify a deviation related to a loudness of an audio signal acquired through the at least one microphone, and determine whether an error related to the at least one microphone occurs, based at least on the deviation.

According to various embodiments of the present disclosure, an operating method of an electronic device includes: acquiring an audio signal through at least one microphone of the electronic device; identifying a deviation related to a loudness of the audio signal; and determining whether an error related to the at least one microphone occurs, based at least on the deviation.

The electronic device and the operating method thereof according to various embodiments can efficiently identify an operation state of an audio component, by detecting an error of the audio component based on at least one of a deviation (standard deviation) related to loudness of an audio signal collected through the microphone, error occurrence information of an echo signal, or detection information of a voice signal.

DETAILED DESCRIPTION OF EXAMPLE EMBODIMENTS

Various embodiments of the present disclosure will be described herein below with reference to the accompanying drawings. In the following description, well-known functions or constructions are not described in detail since they would obscure the invention in unnecessary detail. Also, the terms used herein are defined according to the functions of the present disclosure. Thus, the terms may vary depending on user's or operator's intension or usage. That is, the terms used herein must be understood based on the descriptions made herein.

Figure 1:
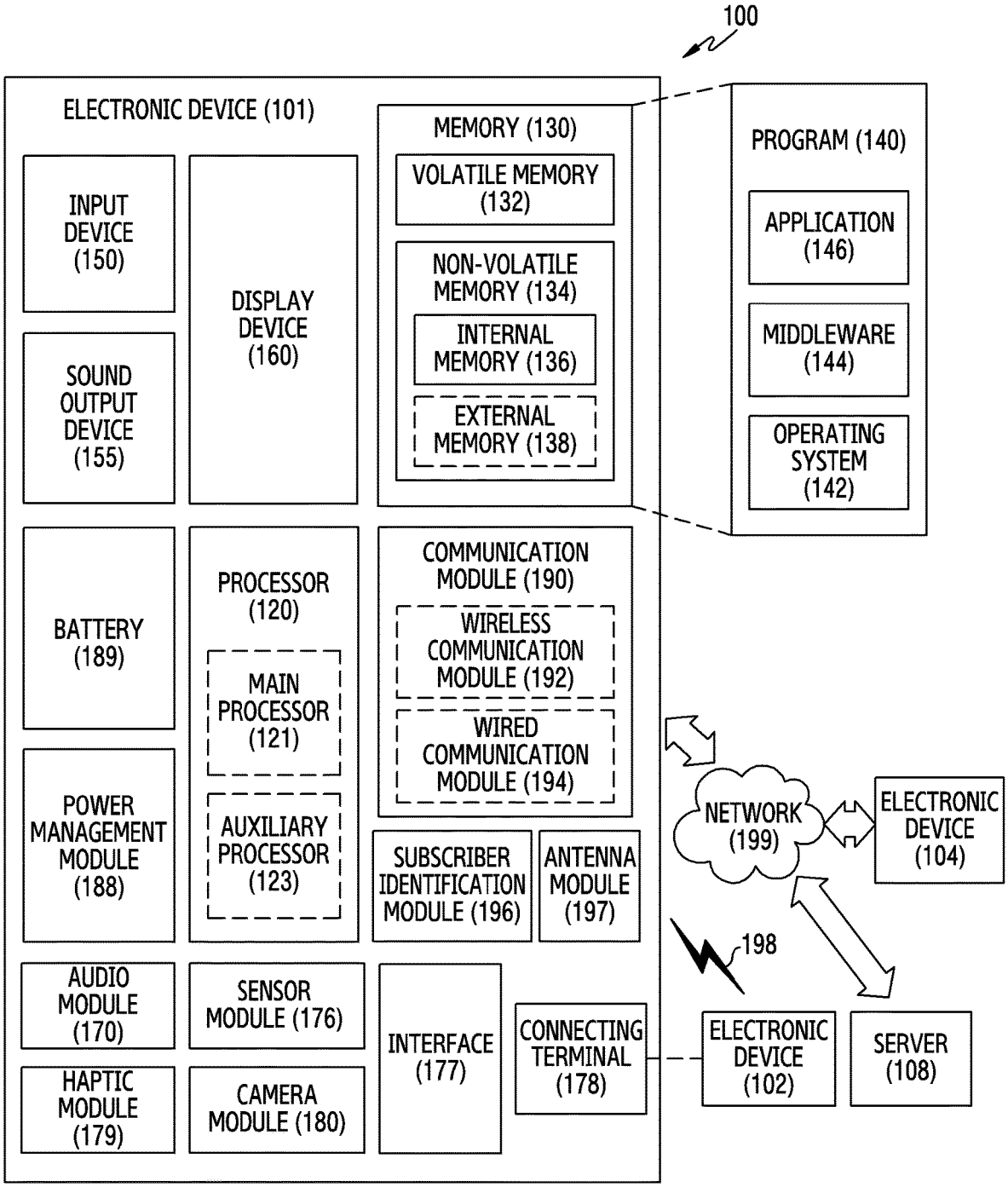
FIG. 1 is a block diagram illustrating an electronic device for determining whether an error occurs in a microphone based on loudness of an audio signal acquired through the microphone in a network environment according to various embodiments of the present disclosure.

FIG. 1 is a block diagram illustrating an electronic device for determining whether an error occurs in a microphone based on loudness of an audio signal acquired through the microphone in a network environment according to various embodiments of the present disclosure. Referring to FIG. 1, the electronic device 101 in the network environment 100 may communicate with an electronic device 102 via a first network 198 (e.g., a short-range wireless communication network), or an electronic device 104 or a server 108 via a second network 199 (e.g., a long-range wireless communication network). According to an embodiment, the electronic device 101 may communicate with the electronic device 104 via the server 108. According to an embodiment, the electronic device 101 may include a processor 120, memory 130, an input device 150, a sound output device 155, a display device 160, an audio module 170, a sensor module 176, an interface 177, a haptic module 179, a camera module 180, a power management module 188, a battery 189, a communication module 190, a subscriber identification module (SIM) 196, or an antenna module 197. In some embodiments, at least one (e.g., the display device 160 or the camera module 180) of the components may be omitted from the electronic device 101, or one or more other components may be added in the electronic device 101. In some embodiments, some of the components may be implemented as single integrated circuitry. For example, the sensor module 176 (e.g., a fingerprint sensor, an iris sensor, or an illuminance sensor) may be implemented as embedded in the display device 160 (e.g., a display).

The processor 120 may execute, for example, software (e.g., a program 140) to control at least one other component (e.g., a hardware or software component) of the electronic device 101 coupled with the processor 120, and may perform various data processing or computation. According to one embodiment, as at least part of the data processing or computation, the processor 120 may load a command or data received from another component (e.g., the sensor module 176 or the communication module 190) in volatile memory 132, process the command or the data stored in the volatile memory 132, and store resulting data in non-volatile memory 134. According to an embodiment, the processor 120 may include a main processor 121 (e.g., a central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of functions or states related to at least one component (e.g., the display device 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). According to an embodiment, the auxiliary processor 123 (e.g., an image signal processor or a communication processor) may be implemented as part of another component (e.g., the camera module 180 or the communication module 190) functionally related to the auxiliary processor 123.

The memory 130 may store various data used by at least one component (e.g., the processor 120 or the sensor module 176) of the electronic device 101. The various data may include, for example, software (e.g., the program 140) and input data or output data for a command related thererto. The memory 130 may include the volatile memory 132 or the non-volatile memory 134.

The program 140 may be stored in the memory 130 as software, and may include, for example, an operating system (OS) 142, middleware 144, or an application 146.

The input device 150 may receive a command or data to be used by other component (e.g., the processor 120) of the electronic device 101, from the outside (e.g., a user) of the electronic device 101. The input device 150 may include, for example, a microphone, a mouse, or a keyboard.

The sound output device 155 may output sound signals to the outside of the electronic device 101. The sound output device 155 may include, for example, a speaker or a receiver. The speaker may be used for general purposes, such as playing multimedia or playing record, and the receiver may be used for an incoming calls. According to an embodiment, the receiver may be implemented as separate from, or as part of the speaker.

The display device 160 may visually provide information to the outside (e.g., a user) of the electronic device 101. The display device 160 may include, for example, a display, a hologram device, or a projector and control circuitry to control a corresponding one of the display, hologram device, and projector. According to an embodiment, the display device 160 may include touch circuitry adapted to detect a touch, or sensor circuitry (e.g., a pressure sensor) adapted to measure the intensity of force incurred by the touch.

The audio module 170 may convert a sound into an electrical signal and vice versa. According to an embodiment, the audio module 170 may obtain the sound via the input device 150, or output the sound via the sound output device 155 or a headphone of an external electronic device (e.g., an electronic device 102) directly (e.g., wired) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. According to an embodiment, the sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., wired) or wirelessly. According to an embodiment, the interface 177 may include, for example, a high definition multimedia interface (HDMI), a universal serial bus (USB) interface, a secure digital (SD) card interface, or an audio interface.

A connecting terminal 178 may include a connector via which the electronic device 101 may be physically connected with the external electronic device (e.g., the electronic device 102). According to an embodiment, the connecting terminal 178 may include, for example, a HDMI connector, a USB connector, a SD card connector, or an audio connector (e.g., a headphone connector), The haptic module 179 may convert an electrical signal into a mechanical stimulus (e.g., a vibration or a movement)

or electrical stimulus which may be recognized by a user via his tactile sensation or kinesthetic sensation. According to an embodiment, the haptic module 179 may include, for example, a motor, a piezoelectric element, or an electric stimulator.

The camera module 180 may capture a still image or moving images. According to an embodiment, the camera module 180 may include one or more lenses, image sensors, image signal processors, or flashes.

The power management module 188 may manage power supplied to the electronic device 101. According to one embodiment, the power management module 188 may be implemented as at least part of, for example, a power management integrated circuit (PMIC).

The battery 189 may supply power to at least one component of the electronic device 101. According to an embodiment, the battery 189 may include, for example, a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more communication processors that are operable independently from the processor 120 (e.g., the application processor (AP)) and supports a direct (e.g., wired) communication or a wireless communication. According to an embodiment, the communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via the first network 198 (e.g., a short-range communication network, such as BLUETOOTH, wireless-fidelity (Wi-Fi) direct, or infrared data association (IrDA)) or the second network 199 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 192 may identify and authenticate the electronic device 101 in a communication network, such as the first network 198 or the second network 199, using subscriber information (e.g., international mobile subscriber identity (IMSI)) stored in the subscriber identification module 196.

The antenna module 197 may transmit or receive a signal or power to or from the outside (e.g., the external electronic device) of the electronic device 101. According to an embodiment, the antenna module 197 may include one or more antennas, and, therefrom, at least one antenna appropriate for a communication scheme used in the communication network, such as the first network 198 or the second network 199, may be selected, for example, by the communication module 190 (e.g., the wireless communication module 192). The signal or the power may then be transmitted or received between the communication module 190 and the external electronic device via the selected at least one antenna.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 101 and the external electronic device 104 via the server 108 coupled with the second network 199. Each of the electronic devices 102 and 104 may be a device of a same type as, or a different type, from the electronic device 101. According to an embodiment, all or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, or client-server computing technology may be used, for example.

Figure 2:
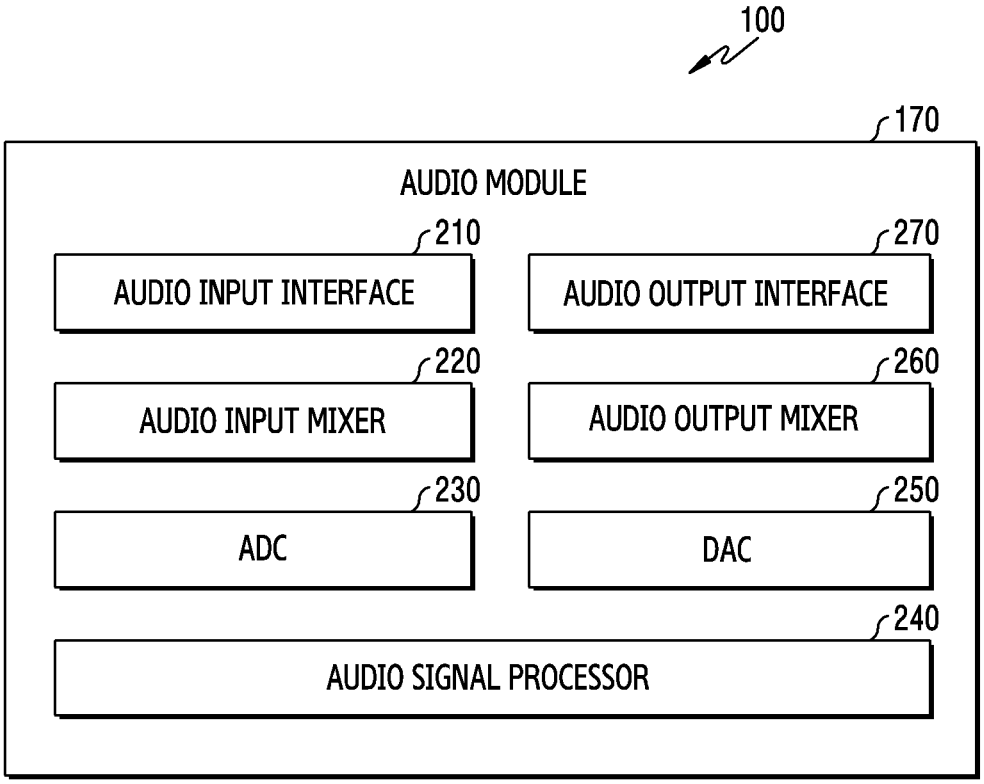
FIG. 2 is a block diagram illustrating an audio module according to various embodiments of the present disclosure.

FIG. 2 is a block diagram 200 illustrating the audio module 170 according to an embodiment of the disclosure.

Referring to FIG. 2, the audio module 170 may include, for example, an audio input interface 210, an audio input mixer 220, an analog-to-digital converter (ADC) 230, an audio signal processor 240, a digital-to-analog converter (DAC) 250, an audio output mixer 260, or an audio output interface 270.

The audio input interface 210 may receive an audio signal corresponding to a sound obtained from the outside of the electronic device 101 via a microphone (e.g., a dynamic microphone, a condenser microphone, or a piezo microphone) that is configured as part of the input device 150 or separately from the electronic device 101. For example, if an audio signal is obtained from the external electronic device 102 (e.g., a headset or a microphone), the audio input interface 210 may be connected with the external electronic device 102 directly via the connecting terminal 178, or wirelessly (e.g., Bluetooth™ communication) via the wireless communication module 192 to receive the audio signal. According to an embodiment, the audio input interface 210 may receive a control signal (e.g., a volume adjustment signal received via an input button) related to the audio signal obtained from the external electronic device 102. The audio input interface 210 may include a plurality of audio input channels and may receive a different audio signal via a corresponding one of the plurality of audio input channels, respectively. According to an embodiment, additionally or alternatively, the audio input interface 210 may receive an audio signal from another component (e.g., the processor 120 or the memory 130) of the electronic device 101.

The audio input mixer 220 may synthesize a plurality of inputted audio signals into at least one audio signal. For example, according to an embodiment, the audio input mixer 220 may synthesize a plurality of analog audio signals inputted via the audio input interface 210 into at least one analog audio signal.

The ADC 230 may convert an analog audio signal into a digital audio signal. For example, according to an embodiment, the ADC 230 may convert an analog audio signal received via the audio input interface 210 or, additionally or alternatively, an analog audio signal synthesized via the audio input mixer 220 into a digital audio signal. The audio signal processor 240 may perform various processing on a digital audio signal received via the ADC 230 or a digital audio signal received from another component of the electronic device 101. For example, according to an embodiment, the audio signal processor 240 may perform changing a sampling rate, applying one or more filters, interpolation processing, amplifying or attenuating a whole or partial frequency bandwidth, noise processing (e.g., attenuating noise or echoes), changing channels (e.g., switching between mono and stereo), mixing, or extracting a specified signal for one or more digital audio signals. According to an embodiment, one or more functions of the audio signal processor 240 may be implemented in the form of an equalizer.

The DAC 250 may convert a digital audio signal into an analog audio signal. For example, according to an embodiment, the DAC 250 may convert a digital audio signal processed by the audio signal processor 240 or a digital audio signal obtained from another component (e.g., the processor (120) or the memory (130)) of the electronic device 101 into an analog audio signal.

The audio output mixer 260 may synthesize a plurality of audio signals, which are to be outputted, into at least one audio signal. For example, according to an embodiment, the audio output mixer 260 may synthesize an analog audio signal converted by the DAC 250 and another analog audio signal (e.g., an analog audio signal received via the audio input interface 210) into at least one analog audio signal.

The audio output interface 270 may output an analog audio signal converted by the DAC 250 or, additionally or alternatively, an analog audio signal synthesized by the audio output mixer 260 to the outside of the electronic device 101 via the sound output device 155. The sound output device 155 may include, for example, a speaker, such as a dynamic driver or a balanced armature driver, or a receiver. According to an embodiment, the sound output device 155 may include a plurality of speakers. In such a case, the audio output interface 270 may output audio signals having a plurality of different channels (e.g., stereo channels or 5.1 channels) via at least some of the plurality of speakers. According to an embodiment, the audio output interface 270 may be connected with the external electronic device 102 (e.g., an external speaker or a headset) directly via the connecting terminal 178 or wirelessly via the wireless communication module 192 to output an audio signal.

According to an embodiment, the audio module 170 may generate, without separately including the audio input mixer 220 or the audio output mixer 260, at least one digital audio signal by synthesizing a plurality of digital audio signals using at least one function of the audio signal processor 240.

According to an embodiment, the audio module 170 may include an audio amplifier (not shown) (e.g., a speaker amplifying circuit) that is capable of amplifying an analog audio signal inputted via the audio input interface 210 or an audio signal that is to be outputted via the audio output interface 270. According to an embodiment, the audio amplifier may be configured as a module separate from the audio module 170.

The electronic device according to various embodiments may be one of various types of electronic devices. The electronic devices may include, for example, a portable communication device (e.g., a smart phone), a computer device, a portable multimedia device, a portable medical device, a camera, a wearable device, or a home appliance. According to an embodiment of the disclosure, the electronic devices are not limited to those described above.

It should be appreciated that various embodiments of the present disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wired), wirelessly, or via a third element.

As used herein, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a complier or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to various embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., PLAYSTORE), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to various embodiments, each component (e.g., a module or a program) of the above-described components may include a single entity or multiple entities. According to various embodiments, one or more of the above-described components may be omitted, or one or more other components may be added. Alternatively or additionally, a plurality of components (e.g., modules or programs) may be integrated into a single component. In such a case, according to various embodiments, the integrated component may still perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

According to an embodiment, the processor 120 may control the audio module 170 to replay an audio signal. For example, when a voice communication function is provided, the processor 120 may control the audio module 170 to output a voice signal received through the communication module 190 through the sound output device 155 (for example, the audio output interface 270 of FIG. 2). For example, the processor 120 may control the audio module 170 to output an audio signal related to a multimedia content through the sound output device 155 (for example, the audio output interface 270 of FIG. 2). For example, the multimedia content may be stored in the memory 130 or may be received from an external electronic device (for example, the electronic device 102 or 104 or the server 108) through the communication module 190.

According to an embodiment, the processor 120 may determine whether an error occurs in at least a portion of the audio module 170 based on an audio signal collected through the input device 150 (for example, the audio input interface 210 of FIG. 2) (for example, a microphone). For example, when an audio signal is outputted through the sound output device 155 (for example, the audio output interface 270 of FIG. 2), the processor 120 may determine whether an error occurs in an audio component, based on at least one of error occurrence information of an echo signal inputted through the input device 150, a standard deviation, or detection information of voice detection.

According to an embodiment, when an audio signal is outputted through the sound output device 155 (for example, the audio output interface 270 of FIG. 2), the processor 120 may detect a standard deviation of an audio signal collected through the input device 150 (for example, the audio input interface 210 of FIG. 2). When the standard deviation of the audio signal continuously falls within a reference range (for example, about ±2 dB) for a reference time, the processor 120 may determine that an error occurs in the input device 150.

According to an embodiment, when an error occurs in an echo signal corresponding to an audio signal outputted through the sound output device 155 (for example, the audio output interface 270 of FIG. 2), the processor 120 may determine that an error occurs in at least a portion of the audio component included in the electronic device 101. For example, when an echo signal is not received through the input device 150 (for example, the audio input interface 210 of FIG. 2) while an audio signal is being outputted through the sound output device 155, the processor 120 may determine that an error occurs in the echo signal. For example, when a similarity between a waveform of the audio signal outputted through the sound output device 155 and a waveform of the echo signal corresponding to the corresponding audio signal is smaller than a reference value, the processor 120 may determine that an error occurs in the echo signal. For example, the echo signal may include at least a portion of the audio signal outputted through the sound output device 155 that is inputted to the input device 150. For example, at least a portion of the audio component may include at least a portion of the audio module 170.

According to an embodiment, the processor 120 may determine whether an error occurs in the audio component through a plurality of sound output devices 155 (for example, the audio output interface 270 of FIG. 2) and a plurality of input devices 150 (for example, the audio input interface 210 of FIG. 2). For example, the processor 120 may determine whether an error occurs in each module through the input device 150 and the sound output device 155 which are adjacent to each other. For example, the input device 150 and the sound output device 155 which are adjacent to each other may be recognized based on configuration information of the audio module 170 or an input level (loudness) of an audio signal collected through the input device 150. For example, when an error occurs in an echo signal collected through a left input device 150 (microphone), the processor 120 may determine that an error occurs in the sound output device 155 adjacent to the left input device 150. For example, when errors of all of the sound output devices 155 are detected at the same time, the processor 120 may determine that an error occurs in the audio signal processor 240 of FIG. 7-2 (for example, an audio codec or amplifier).

According to an embodiment, the processor 120 may control the communication module 190 to transmit data related to the error of the audio component to an external electronic device (for example, the electronic device 102 or 104 or the server 108). For example, the data related to the error of the audio component may include at least one of a module of the audio component in which the error is detected, a place where the error of the audio component is detected, a time at which the error of the audio component is detected, or information of an application which is being executed in the electronic device 101 when the error is detected.

According to an embodiment, the processor 120 may control to change a main microphone to collect an audio signal. For example, when an application related to an audio signal is executed, the processor 120 may identify a main microphone among a plurality of microphones (for example, the audio input interface 210) included in the electronic device 101. The processor 120 may determine whether an error occurs in the main microphone, based on at least one of error occurrence information of an echo signal inputted through the main microphone while the application is being executed, a standard deviation, or detection information of voice detection. When an error occurs in the main microphone, the processor 120 may change the main microphone of the application to another microphone. For example, when the main microphone is changed, the processor 120 may control the display device (display) 160 to output microphone change information. For example, the application related to the audio signal may include an application outputting or collecting an audio signal.

According to an embodiment, the processor 120 may control the display device 160 to output information related to the error of the audio component. For example, when an error of at least a portion of the audio component included in the electronic device 101 is detected, the processor 120 may determine whether error occurrence information is outputted, based on an error detection history of the audio component. When it is determined that the error occurrence information is outputted, the processor 120 may control the display device 160 to display the error occurrence information. For example, the error occurrence history may include the number of times that an error occurs.

According to various embodiments of the present disclosure, an electronic device may include: at least one sound output device; at least one microphone; and a processor, and the processor may be configured to identify a deviation related to a loudness of an audio signal acquired through the at least one microphone, and to determine whether an error related to the at least one microphone occurs, based at least on the deviation.

According to various embodiments, when the deviation continuously falls within a specified range for a specified time, the processor may be configured to determine that an error occurs in the at least one microphone.

According to various embodiments, the processor may be configured to execute an application, to output an audio signal related to the application through the at least one sound output device, to receive at least a portion of the audio signal related to the application through the at least one microphone, while outputting the audio signal related to the application through the at least one sound output device, and to identify a deviation related to a loudness of the at least portion of the audio signal related to the application, received through the at least one microphone.

According to various embodiments, the processor may be configured to determine whether an error occurs in an echo signal corresponding to the audio signal outputted through the at least one sound output device, and to determine whether an error occurs in an audio component at least including the at least one microphone, further based on error occurrence information of the echo signal.

According to various embodiments, the processor may be configured to determine whether a voice signal is detected through the at least one microphone, and to determine whether an error occurs in the audio component, further based on detection information of the voice signal.

According to various embodiments, the audio component may include at least one of the at least sound output device, an audio codec, or an amplifier.

According to various embodiments, the electronic device may further include a communication module. When it is determined that an error occurs in the at least one microphone, the processor may be configured to transmit data related to the occurred error to an external electronic device through the communication module.

According to various embodiments, the electronic device may further include a display device, and, when it is determined that an error occurs in the at least one microphone, the processor may be configured to display information related to the occurred error through the display device.

According to various embodiments, when it is determined that an error occurs in the at least one microphone, the processor may be configured to identify an error occurrence history of the at least one microphone, and to display information related to the occurred error through the display device based at least on the error occurrence history.

According to various embodiments, the at least one microphone may include a first microphone and a second microphone, and, when an application is executed, the processor may be configured to determine the first microphone among the at least one microphone as a main microphone corresponding to the application, and, when an error occurs in the first microphone, the processor may be configured to change the first microphone to the second microphone among the at least one microphone as the main microphone corresponding to the application.

Figure 3:
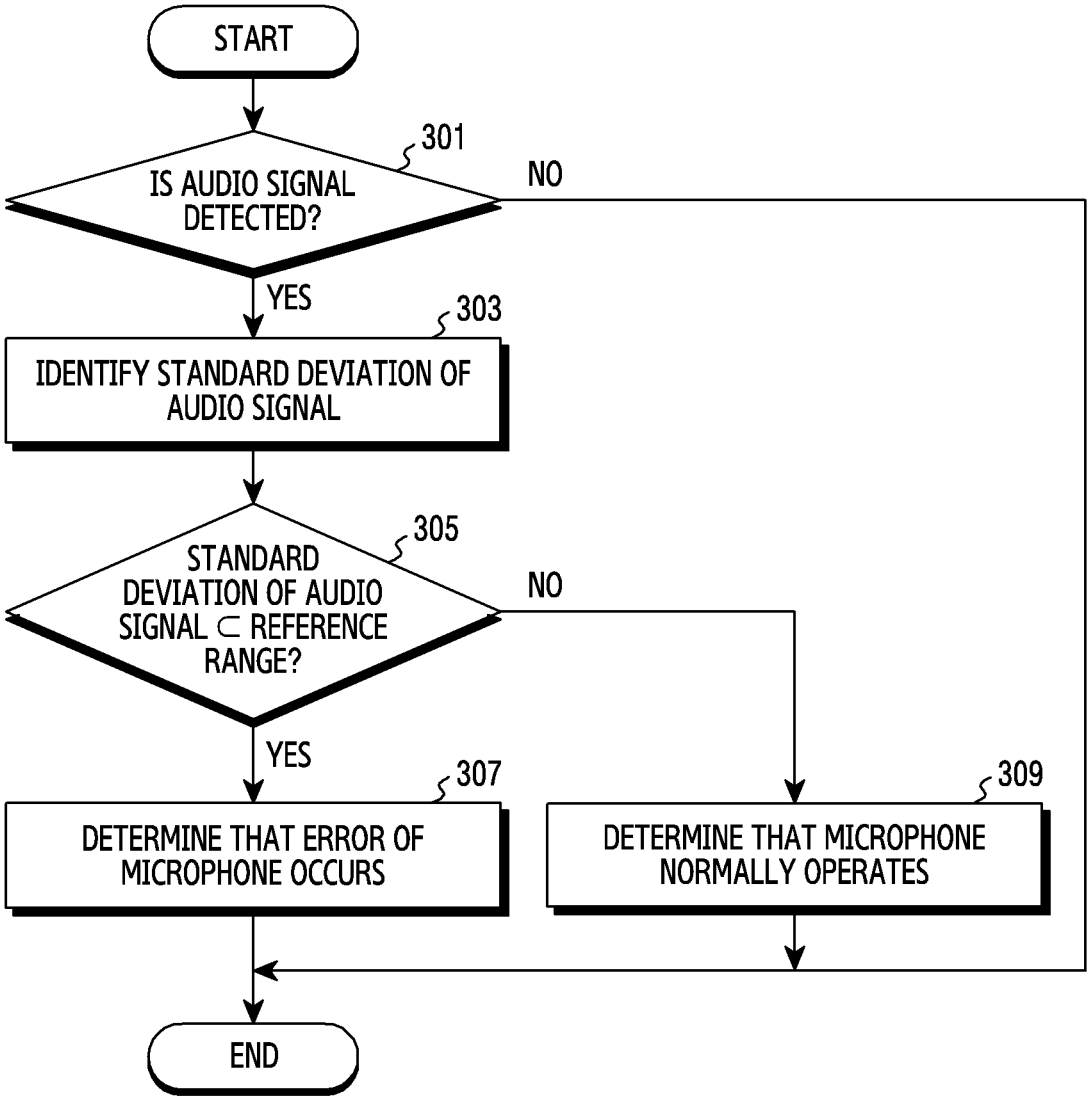
FIG. 3 is a flowchart for detecting an error of a microphone in an electronic device according to various embodiments of the present disclosure.

FIG. 3 is a flowchart for detecting an error of a microphone in an electronic device according to various embodiments of the present disclosure. FIG. 4 is a view illustrating an input signal of a microphone used to detect an error of the microphone according to various embodiments of the present disclosure. In the following description, the electronic device may include the electronic device 101 of FIG. 1 and at least a portion (for example, the processor 120) of the electronic device 101. In the following description, the microphone may include the input device 150 of FIG. 1 or the audio input interface 210 of FIG. 2.

Referring to FIG. 3, in operation 301, the electronic device may determine whether an audio signal is detected through a microphone of the electronic device. For example, when an application related to an audio signal is executed, the processor 120 may determine whether there exists an audio signal acquired through at least one microphone. For example, the processor 120 may determine whether there exists an audio signal collected through at least one microphone while an audio signal is being outputted through a speaker (for example, the sound output device 155 of FIG. 1 or the audio output interface 270 of FIG. 2) based on execution of the application.

When an audio signal is detected through a microphone, the electronic device may identify a deviation related to loudness of the audio signal in operation 303. For example, the deviation related to the loudness of the audio signal may include a root mean square (RMS) deviation related to the loudness of the audio signal collected through the microphone (for example, the audio input interface 210 of FIG. 2).

In operation 305, the electronic device may determine whether the deviation (standard deviation) related to the loudness of the audio signal falls within a reference range for determining occurrence of an error. For example, the reference range may be fixed or may be determined based on at least one of a characteristic (for example, sensitivity) of the microphone, a location where the audio signal is collected, or an ambient noise.

Figures 4A, 4B:
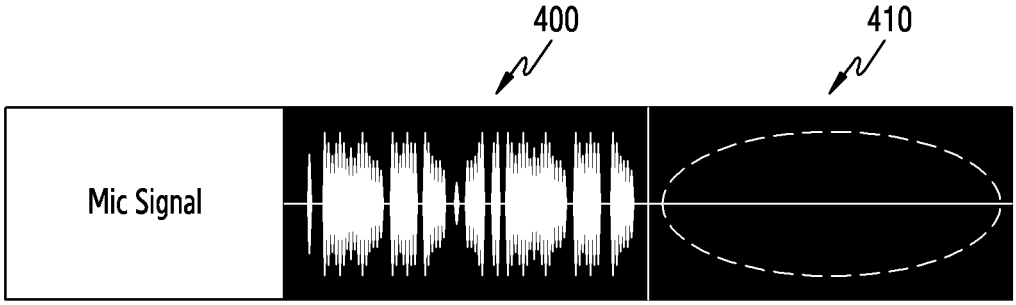
FIGS. 4A and 4B are views illustrating an input signal of a microphone used to detect an error of the microphone according to various embodiments of the present disclosure.

When the deviation related to the loudness of the audio signal falls within the reference range, the electronic device may determine that an error occurs in the microphone collecting the audio signal in operation 307. For example, when the standard deviation of the audio signal continuously falls within the reference range for a reference time (410) as shown in FIG. 4B, the processor 120 may determine that an error occurs in the microphone acquiring the audio signal.

According to an embodiment, when the error of the microphone is detected, the electronic device may transmit data related to the error occurrence of the microphone to an external electronic device (for example, the electronic device 102 or 105) or the server 108. For example, the data related to the error occurrence of the microphone may include at least one of a place where the error of the microphone is detected, a time at which the error is detected, or information of the application which is being executed in the electronic device 101 when the error is detected.

When the deviation related to the loudness of the audio signal falls out of the reference range, the electronic device may determine that the microphone collecting the audio signal normally operates in operation 309. For example, when the standard deviation of the audio signal is continuously changed (400) as shown in FIG. 4A, the processor 120 may determine that the microphone collecting the audio signal normally operates.

Figure 5:
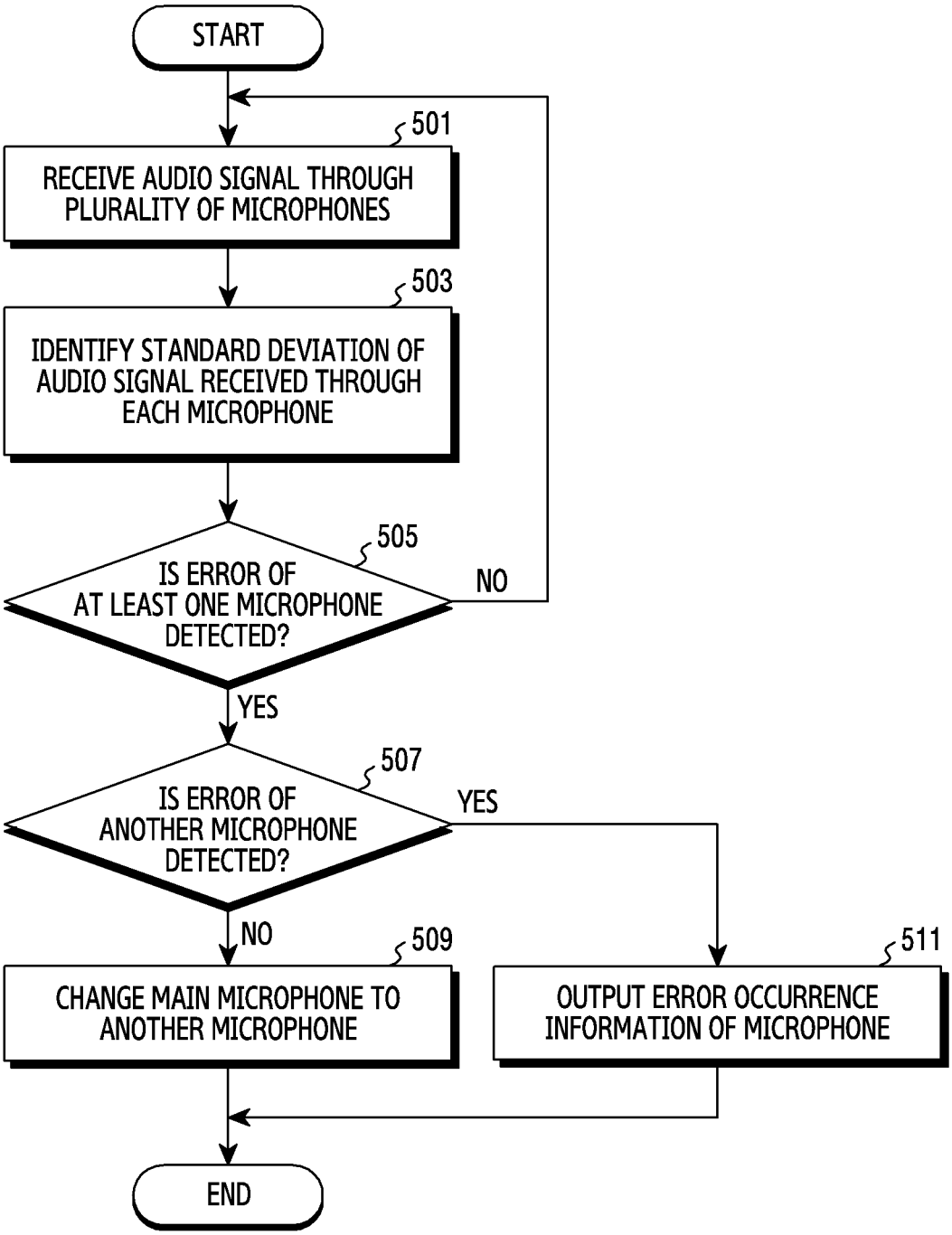
FIG. 5 is a flowchart for changing a microphone in an electronic device according to various embodiments of the present disclosure.
Figure 6:
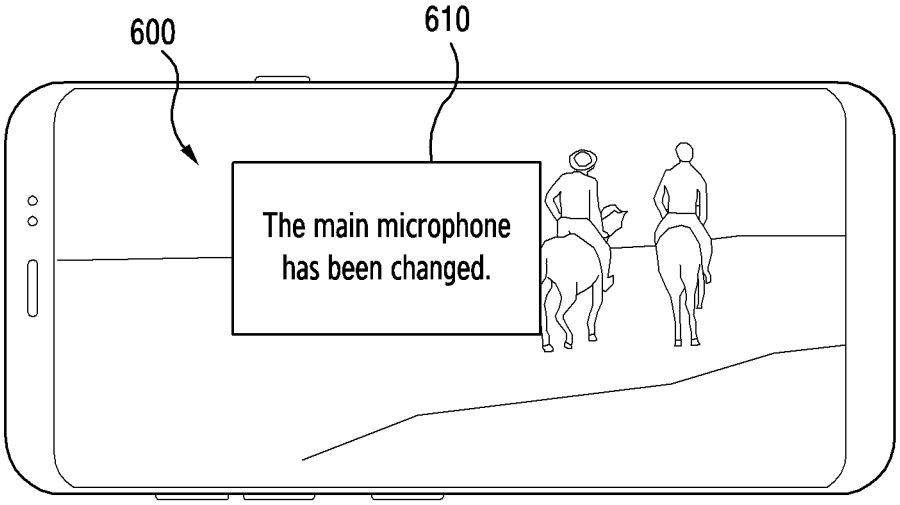
FIG. 6 is a view illustrating a screen configuration for outputting microphone change information in an electronic device according to various embodiments of the present disclosure.
Figure 7:
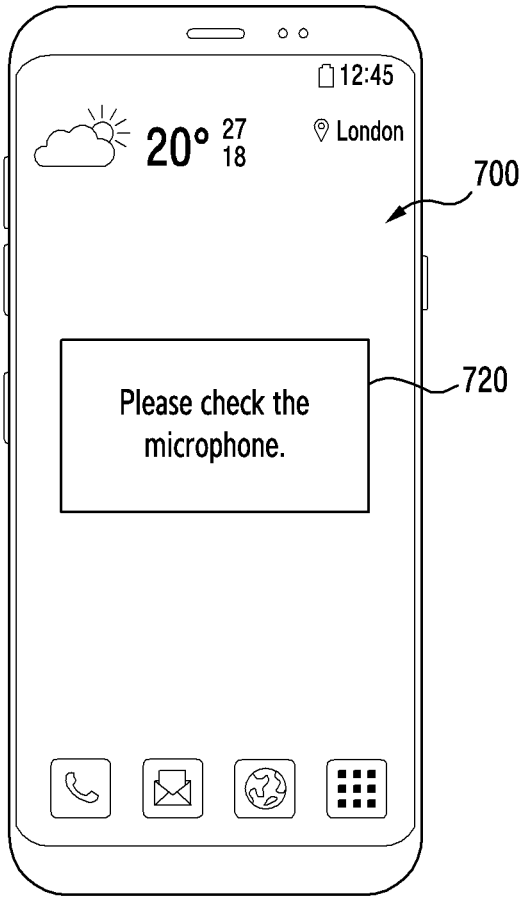
FIG. 7 is a view illustrating a screen configuration for outputting error information of a microphone in an electronic device according to various embodiments of the present disclosure.

FIG. 5 is a flowchart for changing a microphone in an electronic device according to various embodiments of the present disclosure. FIG. 6 is a view illustrating a screen configuration for outputting microphone change information in an electronic device according to various embodiments of the present disclosure. FIG. 7 is a view illustrating a screen configuration for outputting error information of a microphone in an electronic device according to various embodiments of the present disclosure. In the following description, the electronic device may include the electronic device 101 of FIG. 1 or at least a portion (for example, the processor 120) of the electronic device 101. In the following description, the microphone may include the input device 150 of FIG. 1 or the audio input interface 210 of FIG. 2.

Referring to FIG. 5, the electronic device may receive audio signals through a plurality of microphones in operation 501. For example, when an application related to an audio signal is executed, the processor 120 may collect audio signals through the plurality of microphones. For example, the audio signals collected through the plurality of microphones may include at least one of an echo signal or an ambient audio signal. For example, the plurality of microphones may be arranged to be spaced apart from one another by longer than a predetermined distance.

In operation 503, the electronic device may identify a standard deviation of the audio signal received through each microphone. For example, the processor 120 may calculate an RMS deviation regarding loudness of the audio signal received through each microphone.

In operation 505, the electronic device may determine whether an error occurs in at least one of the plurality of microphones (for example, a main microphone), based on standard deviations of the audio signals received through the plurality of microphones. For example, when a standard deviation of the main microphone of the plurality of microphones continuously falls within a specified range (reference range) for a specified time (reference time), the processor 120 may determine that an error occurs in the main microphone. For example, the main microphone may be set among the plurality of microphones, based on at least one of the application which is executed in the electronic device 101 or a location of a user of the electronic device 101.

When an error does not occur in at least one microphone of the plurality of microphone, the electronic device may receive audio signals through the plurality of microphones in operation 501.

When an error of at least one microphone of the plurality of microphones is detected, the electronic device may determine whether an error occurs in another microphone (for example, a sub microphone), based on the standard deviations of the audio signals received through the plurality of microphones in operation 507. For example, the processor 120 may determine whether an error occurs in the microphones in sequence based on a priority of at least one microphone. The processor 120 may determine whether there is a microphone having no error among the at least one microphone. For example, when it is determined that a microphone having a first priority normally operates, the processor 120 may finish the operation of determining the occurrence of the error of the microphone.

When an error does not occur in another microphone, the electronic device may change the main microphone corresponding to the application to another microphone having no error in operation 509. For example, when there is another microphone normally operating, the processor 120 may set another microphone normally operating to the main microphone corresponding to the application. For example, when the processor 120 changes the main microphone corresponding to the application to another microphone, the processor 120 may control the display device 160 to display a guidance message 610 related to the change of the main microphone on at least a portion 600 of the display device 160, as shown in FIG. 6.

When an error of another microphone is detected, the electronic device may output error occurrence information of the microphone in operation 511. For example, when there is no microphone normally operating among the plurality of microphones included in the electronic device 101, the processor 120 may determine that there is no microphone to be used as the main microphone of the application. For example, the processor 120 may control the display device 160 to display a guidance message 720 related to the occurrence of the error of the microphone on at least a portion 700 of the display device 160 as shown in FIG. 7, such that a user can recognize the restriction of the use of microphone.

Figure 8:
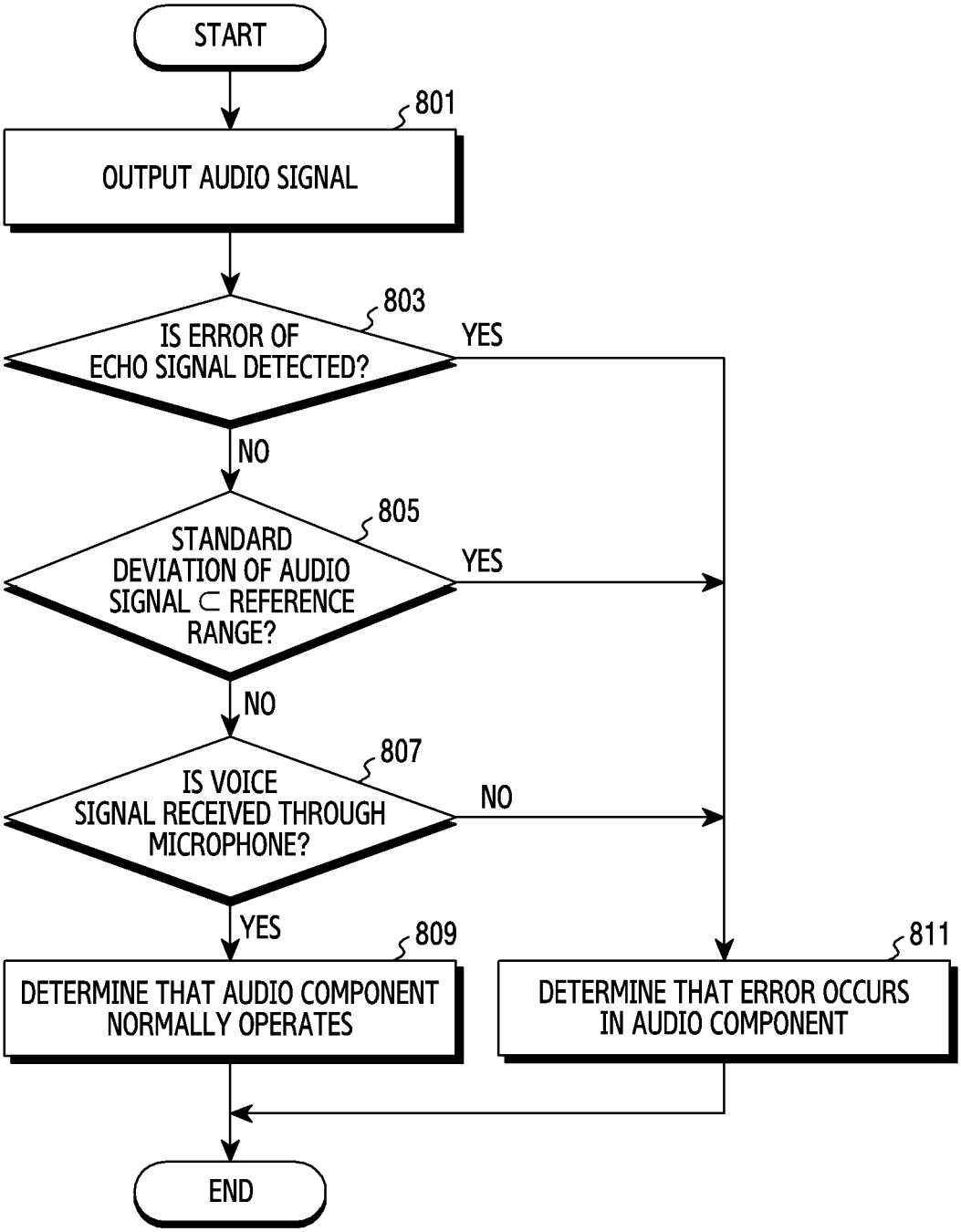
FIG. 8 is a flowchart for detecting an error of an audio component in an electronic device according to various embodiments of the present disclosure.
Figure 9:
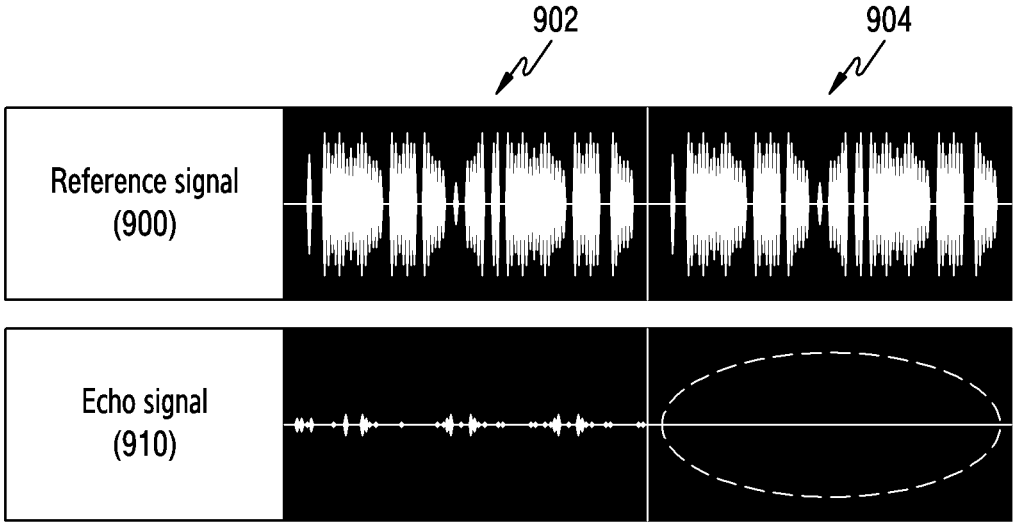
FIGS. 9A and 9B are views illustrating an input signal of a microphone used to detect an error of an audio component according to various embodiments of the present disclosure.

FIG. 8 is a flowchart for detecting an error of an audio component in an electronic device according to various embodiments of the present disclosure. FIG. 9 is a view illustrating an input signal of a microphone used to detect an error of an audio component according to various embodiments of the present disclosure. In the following description, the electronic device may include the electronic device 101 of FIG. 1 or at least a portion (for example, the processor 120) of the electronic device 101. In the following description, the audio component may include the audio module 170 of FIG. 2 or at least a portion of the audio module 170.

Referring to FIG. 8, the electronic device may output an audio signal through a speaker (for example, the audio output device 155 of FIG. 1 or the audio output interface 270 of FIG. 2). For example, when an application related to an audio signal is executed, the processor 120 may control the audio module 170 to output a voice signal related to the application or an audio signal of a multimedia content through the speaker.

In operation 803, the electronic device may determine whether an error of an echo signal is detected. For example, when a similarity between a waveform 902 of a reference signal 900 and a waveform 912 of an echo signal 910 corresponding to the corresponding audio signal is smaller than a reference value as shown in FIG. 9A, the processor 120 may determine that an error occurs in the echo signal 910. For example, the reference signal may include the audio signal outputted through the speaker. For example, when the echo signal 910 corresponding to the audio signal 900 outputted through the speaker is not received (914) as shown in FIG. 9B, the processor 120 may determine that an error occurs in the echo signal. For example, the echo signal may include at least a portion of the audio signal outputted through the speaker that is inputted through a microphone.

When the error of the echo signal is not detected, the electronic device may determine whether a standard deviation of an audio signal collected through the microphone (for example, the audio input interface 210 of FIG. 2) falls within a reference range in operation 805. For example, the processor 120 may determine whether the standard deviation regarding the loudness of the audio signal collected through the microphone continuously falls within the reference range (for example, about ±2 dB) for a reference time.

When the standard deviation of the audio signal collected through the microphone falls out of the reference range, the electronic device may determine whether a voice signal is detected through the microphone in operation 807. For example, the processor 120 may determine whether a voice signal is detected in the audio signals collected through the microphone.

When the voice signal is detected through the microphone, the electronic device may determine that the audio component normally operates in operation 809. For example, when the error of the echo signal corresponding to the audio signal outputted through the speaker is not detected, the standard deviation of the audio signal collected through the microphone falls out of the reference range, and the voice signal is detected through the microphone, the processor 120 may determine that the audio module 170 of the electronic device 101 normally operates.

When the error of the echo signal corresponding to the audio signal outputted through the speaker is detected, the standard deviation of the audio signal collected through the microphone falls within the reference range, or the voice signal is not detected through the microphone, the electronic device may determine that an error occurs in at least a portion of the audio component included in the electronic device 101 in operation 811. For example, the processor 120 may identify at least a portion of the audio component included in the electronic device 101 in which an error occurs, based on error information of the echo signal, error information regarding the standard deviation of the audio signal, and detection information of the voice signal, as shown in table 1 presented below:

TABLE 1

| Standard deviation of audio signal | Echo signal | Voice signal | Explanations |
|---|---|---|---|
| Falling within the reference range | Error occurred | Not detected | An error in the microphone |
| Falling within the reference range | Error occurred | Detected | An error in the speaker, a small voice signal generated through the microphone (microphone error) |
| Falling within the reference range | Normal | Not detected | A small echo signal generated through the microphone (microphone error) |
| Falling within the reference range | Normal | Detected | A small echo signal and a voice signal generated through the microphone (microphone error) |

TABLE 1-continued

| Standard deviation of audio signal | Echo signal | Voice signal | Explanations |
|---|---|---|---|
| Falling out of the reference range | Error occurred | Not detected | An error in the speaker, a noise signal generated through the microphone (microphone error) |
| Falling out of the reference range | Error occurred | Detected | An error in the speaker |
| Falling out of the reference range | Normal | Not detected | A noise signal generated through the microphone (microphone error) |

According to an embodiment, when an error of at least one of the audio component included in the electronic device is detected, the electronic device may transmit data related to the occurrence of the error of the audio component to an external electronic device (for example, the electronic device 102 or 104 or the server 108). For example, the data related to the occurrence of the error may include at least one of a module in which the error is detected, a place in which the error is detected, a time at which the error is detected, or information of an application which is being executed in the electronic device 101 when the error is detected.

According to various embodiments of the present disclosure, the electronic device may perform the operation of detecting the error of the echo signal (operation 803), the operation of detecting the error based on the standard deviation of the audio signal (operation 805), and the operation of detecting the voice signal (operation 807) in parallel. In addition, the order of execution of each operation may be changed.

Figure 10:
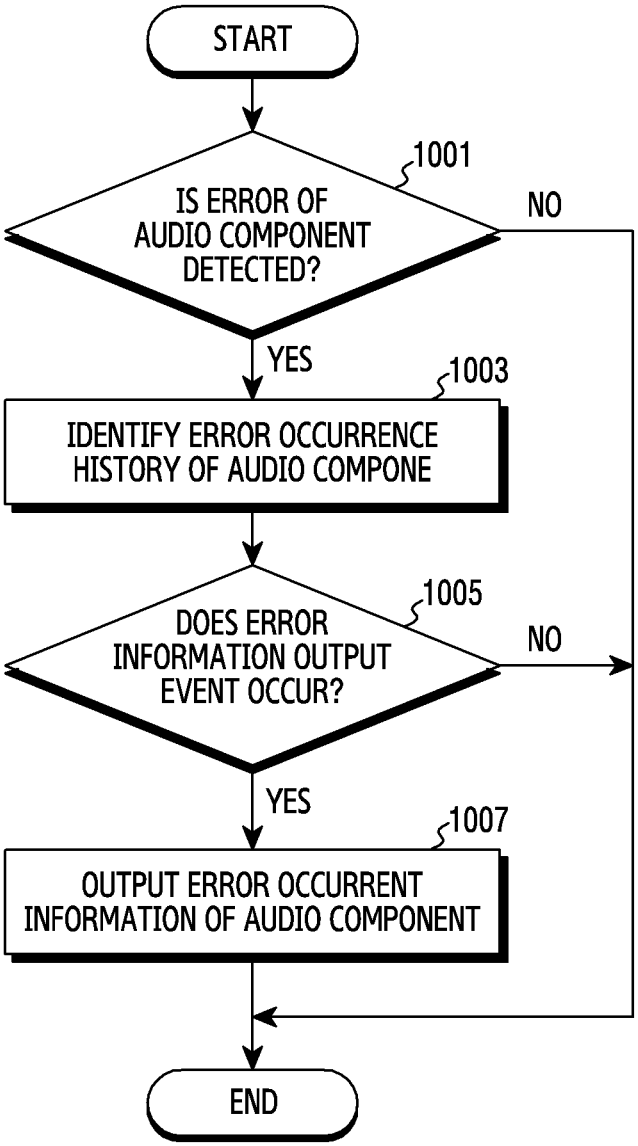
FIG. 10 is a flowchart for outputting error occurrence information of an audio component in an electronic device according to various embodiments of the present disclosure.

FIG. 10 is a flowchart for outputting error occurrence information of an audio component in an electronic device according to various embodiments of the present disclosure. In the following description, the electronic device may include the electronic device 101 of FIG. 1 or at least a portion (for example, the processor 120) of the electronic device 101. In the following description, the audio component may include the audio module 170 of FIG. 2 or at least a portion of the audio module 170.

Referring to FIG. 10, the electronic device may determine whether an error of the audio component included in the electronic device is detected in operation 1001. For example, the processor 120 may determine whether an error occurs in at least a portion of the audio component included in the electronic device 101, based on at least one of error information of an echo signal, error information based on a standard deviation of an audio signal, or detection information of a voice signal.

When the error of at least a portion of the audio component included in the electronic device is detected, the electronic device may identify an error occurrence history of the audio component in operation 1003. For example, when it is determined that an error occurs in at least a portion of the audio component included in the electronic device 101, the processor 120 may identify the number of times that an error occurs in the audio component.

In operation 1005, the electronic device may determine whether an output event of error information occurs based on the error occurrence history of the audio component. For example, the processor 120 may determine whether the output event of the error information occurs by comparing the number of times that an error occurs in the audio component included in the electronic device 101, and a reference number of times. For example, when the number of times that the error occurs in the audio component included in the electronic device 101 exceeds the reference number of times, the processor 120 may determine that the output event of the error information occurs.

When the output event of the error information occurs, the electronic device may output error occurrence information regarding the audio component included in the electronic device in operation 1007. For example, the processor 120 may control at least one of the sound output device 155, the display device 160, the haptic module 179, or THE indicator, such that the user can recognize the error occurrence information of the audio component included in the electronic device 101.

According to various embodiments of the present disclosure, an operating method of an electronic device may include: acquiring an audio signal through at least one microphone of the electronic device; identifying a deviation related to a loudness of the audio signal; and determining whether an error related to the at least one microphone occurs, based at least on the deviation.

According to various embodiments, determining whether the error occurs may include: when the deviation continuously falls within a specified range for a specified time, determining that an error occurs in the at least one microphone; and, when the deviation falls out of the specified range, determining that the at least one microphone normally operates.

According to various embodiments, receiving the audio signal may include: executing an application; outputting an audio signal related to the application through at least one sound output device of the electronic device; and receiving at least a portion of the audio signal related to the application through the at least one microphone, while outputting the audio signal related to the application through the at least one sound output device.

According to various embodiments, the operating method may further include: determining whether an error occurs in an echo signal corresponding to the audio signal related to the application, outputted through the at least one sound output device; and determining whether an error occurs in an audio component at least including the at least one microphone, further based on error occurrence information of the echo signal.

According to various embodiments the operating method may further include: determining whether a voice signal is detected through the at least one microphone; and determining whether an error occurs in the audio component, further based on detection information of the voice signal.

According to various embodiments, the audio component may include at least one of the at least sound output device, an audio codec, or an amplifier.

According to various embodiments, the operating method may further include, when it is determined that an error occurs in the at least one microphone, transmitting data related to the occurred error to an external electronic device through a communication module of the electronic device.

According to various embodiments, the operating method may further include, when it is determined that an error occurs in the at least one microphone, outputting information related to the occurred error through a display device of the electronic device.

According to various embodiments, outputting the information related to the occurred error may include: when it is determined that an error occurs in the at least one microphone, identifying an error occurrence history of the at least one microphone; and displaying information related to the occurred error through the display device based at least on the error occurrence history.

According to various embodiments, the operating method may further include: when an application is executed, determining a first microphone included in the at least one microphone as a main microphone corresponding to the application; and, when it is determined that an error occurs in the first microphone, changing the main microphone corresponding to the application to a second microphone included in the at least one microphone.

According to various embodiments of the present disclosure, a non-transitory computer-readable storage medium stores one or more programs for executing: receiving an audio signal through at least one microphone; identifying a standard deviation of the audio signal; and determining whether an error related to the at least one microphone occurs, based on the standard deviation of the audio signal.

The present disclosure has been described with reference to various example embodiments thereof. It will be understood by a person skilled in the art that the present disclosure can be implemented in modified forms without departing from the essential characteristics of the present disclosure. Therefore, disclosed embodiments should be considered from a descriptive perspective, not from a limited perspective. The scope of the present disclosure is defined not by the detailed description but by the appended claims, and all differences within the scope should be understood as being included in the present disclosure.

What is claimed is:

1. An electronic device comprising:

at least one sound output device;

at least one microphone; and a processor configured to:

output an audio signal through the at least one sound output device, receive at least a portion of the audio signal through the at least one microphone, while outputting the audio signal through the at least one sound output device, determine whether an error occurs in an echo signal corresponding to the audio signal outputted through the at least one sound output device, based on a similarity between the audio signal and the echo signal, identify a standard deviation related to a loudness of the at least a portion of the audio signal, and determine, based at least on error occurrence information of the echo signal and the standard deviation continuously falling within a specified range for a specified time, that an error occurs in an audio component including the at least one sound output device and the at least one microphone.

2. The electronic device of claim 1, wherein the processor is configured to:

execute an application; and output the audio signal related to the application through the at least one sound output device.

3. The electronic device of claim 1, wherein the processor is configured to determine whether a voice signal is detected through the at least one microphone, and to determine whether an error occurs in the audio component, further based on detection information of the voice signal.

4. The electronic device of claim 3, wherein the audio component further includes at least one of an audio codec or an amplifier.

5. The electronic device of claim 1, further comprising a communication module, wherein the processor is configured to, based on determining that an error occurs in the at least one microphone, transmit data related to the occurred error to an external electronic device through the communication module.

6. The electronic device of claim 1, further comprising a display device, wherein the processor is configured to, based on determining that an error occurs in the at least one microphone, display information related to the occurred error through the display device.

7. The electronic device of claim 1, wherein the at least one microphone comprises a first microphone and a second microphone, and wherein the processor is configured to, based on an application being executed, determine the first microphone among the at least one microphone as a main microphone corresponding to the application, and, based on an error occurring in the first microphone, change the first microphone to the second microphone among the at least one microphone as the main microphone corresponding to the application.

8. The electronic device of claim 6, wherein the processor is configured to, based on determining that an error occurs in the at least one microphone, identify an error occurrence history of the at least one microphone, and control to display information related to the occurred error through the display device based at least on the error occurrence history.

9. An operating method of an electronic device, the method comprising:

outputting an audio signal through at least one sound output device;

receiving at least a portion of the audio signal through at least one microphone, while outputting the audio signal through the at least one sound output device;

determining whether an error occurs in an echo signal corresponding to the audio signal outputted through the at least one sound output device, based on a similarity between the audio signal and the echo signal;

identifying a standard deviation related to a loudness of the at least a portion of the audio signal; and determining, based at least on error occurrence information of the echo signal and the standard deviation continuously falling within a specified range for a specified time, that an error occurs in an audio component including the at least one sound output device and the at least one microphone.

10. The operating method of claim 9, wherein outputting an audio signal through the at least one sound output device comprises:

executing an application;

outputting an audio signal related to the application through at least one sound output device of the electronic device.

11. The operating method of claim 9, further comprising:

determining whether a voice signal is detected through the at least one microphone; and determining whether an error occurs in the audio component, further based on detection information of the voice signal.

12. The operating method of claim 9, further comprising:

when an application is executed, determining a first microphone included in the at least one microphone as a main microphone corresponding to the application; and based on determining that an error occurs in the first microphone, changing the main microphone corresponding to the application to a second microphone included in the at least one microphone.

13. The operating method of claim 11, wherein the audio component further includes at least one of an audio codec or an amplifier.

14. The operating method of claim 9, further comprising, based on determining that an error occurs in the at least one microphone, transmitting data related to the occurred error to an external electronic device through a communication module of the electronic device.

15. The operating method of claim 9, further comprising, based on determining that an error occurs in the at least one microphone, outputting information related to the occurred error through a display device of the electronic device.

16. The operating method of claim 15, wherein outputting the information related to the occurred error comprises:

based on determining that an error occurs in the at least one microphone, identifying an error occurrence history of the at least one microphone; and displaying information related to the occurred error through the display device based at least on the error occurrence history.

* * * * *